United States Patent [19]

Kim

[11] Patent Number: 5,000,602

[45] Date of Patent: Mar. 19, 1991

[54] PAINT APPLICATOR

[76] Inventor: Dae S. Kim, 49 Floral St., Newton, Mass. 02161

[21] Appl. No.: 535,899

[22] Filed: Jun. 11, 1990

Related U.S. Application Data

[63] Continuation-in-part of Ser. No. 388,563, Aug. 1, 1989, abandoned.

[51] Int. Cl.[5] ..... A46B 11/02

[52] U.S. Cl. ..... 401/152; 401/156; 401/132; 401/268

[58] Field of Search ..... 401/156, 152, 208, 17, 401/172, 256, 265, 266, 196, 268; 15/210

[56] References Cited

U.S. PATENT DOCUMENTS

| | | | |
|---|---|---|---|
| 2,711,098 | 6/1955 | Ames | 401/171 |
| 2,809,513 | 10/1957 | Ames | 401/171 X |
| 2,824,326 | 2/1958 | Ames | 401/171 |
| 2,824,442 | 2/1958 | Ames | 401/171 X |
| 3,070,824 | 1/1963 | Martin | 401/208 |
| 3,070,825 | 1/1963 | Martin | 401/208 |
| 3,918,820 | 11/1975 | Kim | 401/132 |

*Primary Examiner*—Richard J. Johnson
*Attorney, Agent, or Firm*—William Nitkin

[57] ABSTRACT

A paint applicator having a housing containing a paint bag, such housing having a flexible and removable face plate and a pressure plate adapted to apply pressure to the paint bag to force paint through openings in the bag aligned with openings in the face plate onto a paint pad for paint application.

10 Claims, 6 Drawing Sheets

PAINT APPLICATOR

This application is a continuation-in-part of my previously filed application for Paint Pad Applicator with Prepackaged Paint Supply, filed 08/01/89, Ser. No. 388,563, now abandoned.

BACKGROUND OF THE INVENTION

1. Field of the Invention

The subject of this invention resides in the area of devices for applying spreadable compositions, such as paint, to relatively smooth and flat surfaces, such as walls, and more particularly relates to a paint applicator structure which includes a paint applicator pad disposed on a housing containing a paint-filled bag.

2. Description of the Prior Art

Many painting devices are well known in the prior art such as brushes, rollers, paint applicator pads and the like. There are many disadvantages with these prior art devices which the Applicant attempted to overcome in his previous invention described in U.S. Pat. No. 3,918,820 issued on Nov. 11, 1975 for a Paint Applicator which device included a housing containing a disposable bag of paint with means to force the paint from the bag to a pad surface for application of the paint to the painting surface. Few significant changes have occurred over the Past fifteen years in devices and methods of painting relatively smooth, flat surfaces. However, in the subsequent use of the Paint Applicator of Applicant's previous invention, many problems became evident. The coupling system between the bag and the opening in the face of the housing proved to be difficult to align and to maintain in a secure fluidtight relationship. Such coupling system utilized a plastic annular ring formed as an integral part of the bag which then had to be aligned with, and attached to, an opening in the face of the housing. The housing further included as an integral part thereof the face of the unit to which the paint pad was adhesively attached. Near the top of the face of the housing was a hinged pressure plate member which was adapted to swing down and be forced against the bag thereby forcing the paint in the bag through the annular coupler on the bag, through the opening in the face and then onto the paint pad for application to the surface to be painted. The hinges attaching the pressure plate to the housing were small pin-like members which did not prove to be strong enough over long periods of use to hold the pressure plate member securely. Further the pressure plate member was maneuvered and forced against the bag by a complex ratchet structure which utilized a plurality of sawtooth grooves disposed at the base of the housing and a complex system of spring-loaded toes which engaged into the sawtooth grooves alternately being forced forward by a trigger with a ratchet on the top thereof as the trigger was depressed and released. In some instances the base of the bag became caught in the teeth of the ratchet mechanism and caused the bag to tear, spilling its contents. Further, the face of the structure, being formed as an integral part of the plastic housing, was stiff, flat and unyielding, and these characteristics created a problem in the application of the paint to the surface as the paint did not reach the corners of the paint pad. Moreover, this device proved to be costly to build because of its structural complexity.

SUMMARY OF THE INVENTION

It is an object of this invention to provide improvements to my above-mentioned invention of 1975 in light of the defects in concept and design that became apparent during commercialization of the product. The need for more ecologically sound and energy-efficient painting devices has increased, and more restrictive laws have been passed to regulate the composition of paint and its disposal. Significant advances have been incorporated into my new device. Instead of having the face as an integral part of the housing as in my prior invention, the face member has now been replaced by a separate metal member, not made of stiff plastic as was the original face, which new separate metal member has many new characteristics such as its ability to bow outward when in use which feature significantly improves its ability to apply paint to a surface. Further the plastic annular coupler mounted on the bag of my prior invention, which had to be aligned with the opening in the face of the housing, has been completely eliminated in my new invention which new invention provides a simpler and far more efficient system of attaching the bag to the face member.

One of the most serious defects in my prior invention was associated with the single hole for supplying paint to the pad. Most commercially available household paints are formulated primarily for brushes and rollers with various rheological modifiers. Thus, using commercially available paints, it was very difficult to obtain an even distribution of paint on a surface without going over the same area several times. Multiple holes in the paint pad of the present invention help to solve this problem. The device of my new invention also incorporates a plurality of apertures such as three in the paint pad, as opposed to one aperture in my previous invention, for a much wider and improved dispersal of paint. The present bag is positioned in the housing and attached to the inside of the face member by a thick layer of water-proof, pressure-sensitive adhesive on annular members disposed on the inside of the face plate surrounding each aperture, which annular members have such self-adhesive material on their interior side facing and attaching them to the inside of the face plate and on their exterior side facing and adhering to the bag when it is positioned in the housing. The bag itself contains no coupling members but has a plain, generally flat face which when pushed against the adhesive members, each of which surrounds each one of the plurality of openings, is adhered in a fluid-tight relationship to the adhesive members, which bag can then be punctured from the front of the device through the openings in the pad with a sharp object. The use of an adhesive disk around each opening on the rear of the face plate allows the bag to be free of any attachment mechanism thereon and no matter where the front panel of the bag contacts the openings, the alignment will automatically be correct because there is a wide area of the front panel of the bag that can align with such openings and be adhered to the adhesive disk members around each opening. The elimination of the complex coupler system also makes the paint bags more economical to produce.

Additional improvements have been made by the elimination of the complex and costly ratchet system and spring-loaded toe structures on the pressure plate of my previous invention by providing in this invention a simplified ratchet structure forming a significant improvement in the art in and of itself and by its use in this invention.

Also disclosed are alternate embodiments of the pressure plate closure mechanism having different structures than that previously disclosed, one of which can be operated by the pressure of one's thumb and another of which can be operated by pulling an elastic cord attached to an arm on the pressure plate with such cord extending to an adjustable lock ring ratchet mounted around a support pole with such cord applying pressure to said arm to close said pressure plate when the cord is pulled.

The pressure plate's hinge mechanism now includes means for retaining the full length of the top of the pressure plate by engaging such pressure plate under an extension of the separable metal face plate which new hinge design has proven to be stronger and far more reliable than the failure-prone small pin-type hinge mechanism of my prior invention.

Therefore it is a further object of my present invention to provide improvements to my original paint applicator which significantly increase its efficiency, economy and ability to spread paint well. It should be further noted that the general idea of my prior invention of using a bag within a housing with a pressure plate forcing the contents out the bag is followed in the present invention and that this method of paint application has significant advantages over the prior art as discussed in my prior U.S. Pat. No. 3,918,820 and reference is made to this patent for statements of all of the basic advantages of such a paint application system.

I would like to compare some features of my prior invention with those of my present invention, amplifying on some of the improvements of the latter. In my prior invention the face was plastic, being an integral part of the housing and was flat, rigid and unyielding which characteristics created problems in paint dispersion over the entire surface of the paint pad. The adhesively bonded, disposable paint pad material mounted on the rigid, flat face tended to favor more intimate contact of one corner over the others during paintIng. This corner tended to wipe off the paint and also to wear that corner's fabric prematurely. The flatness of the face necessitated a thick pad material and required the use of great care to achieve an even coating. It has subsequently been discovered by me that by using a separable, thin, metal face plate to support the paint pad, the force from the pressure plate pushing the bag against such metal face plate causes the metal face plate to bow outward centrally from the pressure of the paint bag, and this central curvature of the paint pad helps provide a smoother application of paint under the pad and eliminates the unevenness of paint distribution of my prior pad mounted on a flat face. When a rigid, flat face is used, as in my prior invention, the corners of the paint pad tend to drag on the paint surface as the paint often does not spread all the way to the corners, disrupting the even spread of the paint. The extent of curvature of the paint pad of this invention can be controlled by the relative excess width of the pad over the housing. Further, because a thinner paint pad can be utilized with this invention as compared with the pad of my prior invention, the user has better control over the supply of paint used and can better control any tendency of the device to drip paint. It has also been found that it is easier to clean thinner pads than thick pads which thick pads often incorporate foam in their construction although it should be noted that pads utilizing a foam base can also be utilized in my new invention if desired.

The disposable paint bag of the present invention, no longer having a plastic annular coupler affixed to it, is cheaper and much easier to manufacture and to install within the housing of this invention because the annular adhesive disk members adhered on the thin, metal face plate adhere to the paint bag wherever the paint bag contacts them. Further the use of adhesive disks which securely attach to the plastic face of the bag around the full perimeter of each opening avoids any leakage of paint around such openings, eliminating the need for paint cleanup within the housing. When the bag is empty, it can be removed and discarded, and a new, full bag can be quickly and easily inserted in its place using the same adhesive disks which remain on the face plate and which adhesive members still remain sticky to adhere to the new bag.

Several new structures are disclosed herein for moving the pressure plate downward against the paint bag to force the paint out the openings onto the pad. As mentioned above, these structures were developed to eliminate the problems of complexity, hinge failure and the tearing of the paint bag encountered in the use of my prior invention. The casing of my new invention has a relatively smooth, slightly curved bottom on which the paint bag rests, and a small notch for receiving a cable in one embodiment. The cable is attached to a notch formed in the pressure plate, and the cable is moved through the device by a ratchet mechanism as described below which mechanism is much simpler than my prior ratchet mechanism. This simpler mechanism creates a significant commercial advantage as well as avoiding the bag-tearing problem encountered when using my prior invention. Also, the guiding wheels as disclosed in my prior U.S. Pat. No. 3,918,820 tended to clog up with paint and stop rotating. Sometimes they would leave markings on the paint surface, and the wheels were difficult to clean. The guiding wheels are replaced herein by a new edge guide. Other means are disclosed for applying pressure to the pressure plate such as by thumb pressure in one embodiment or by lever action with a stretchable cord member pulling downward on an arm attached to the hinged pressure plate, such cord retained in a tensioned state by a ring ratchet around a support pole for the device.

These and other features of my present invention will be shown with reference to the drawings described below and the Description of the Preferred Embodiment(s).

DESCRIPTION OF THE PREFERRED EMBODIMENT(S)

Figures 1, 2:
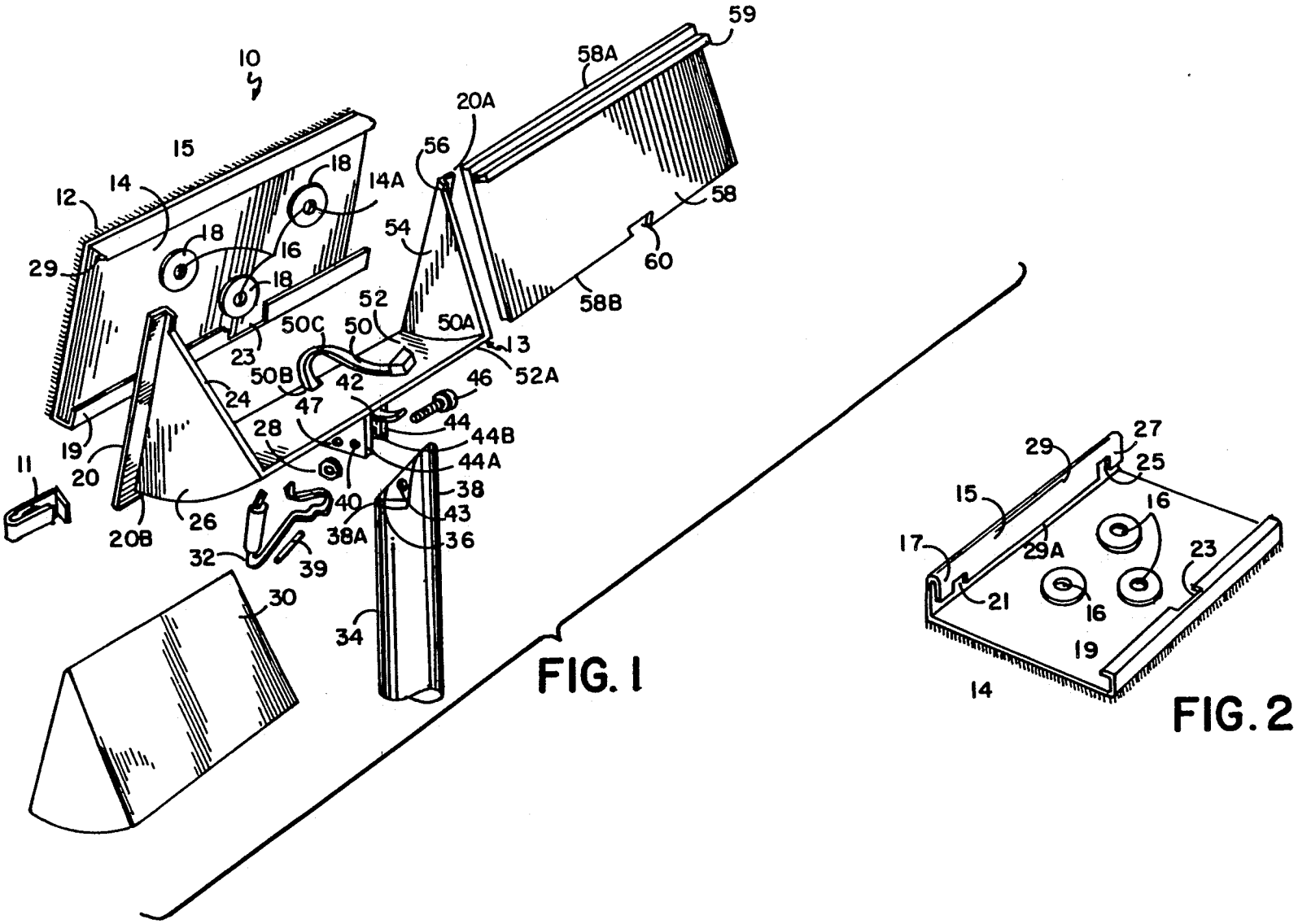
FIG. 1 is a perspective exploded view of the components of one embodiment of the Paint Applicator of my invention.
FIG. 2 is a perspective view of the removable paint pad, metal face plate, and adhesive bag attachments.

FIG. 1 illustrates an exploded view of one embodiment of the paint applicator of this invention showing device 10 which has housing 13. Housing 13 has a transversely curved, substantially smooth, rigid bottom 52 having upper and lower surfaces and two generally triangular-shaped rigid side members, first side member 24 and second side member 54 which are attached at their bottoms to the sides of bottom 52. Each side member has an outwardly extending side lip 20 and **20*a* extending laterally from the front side of each side member 24 and 54, respectively. Each side member 24 and 54 extends upward forming a generally acute angle at its top, but each has a portion thereof extending further almost straight upwards but at a slightly sloping angle from each edge of the rear of the sides not carrying side lips 20 and 20*a* which extensions form first and second catch members 22 and 56, respectively, one of which is also seen in enlarged view in FIG. 5. These catch members are important features for attachment of the removable face plate as will be discussed further below. Extending downward from the front of bottom 52 is bottom lip 20*b* which extends also outward to side lips 20 and 20*a***.

Figure 4:
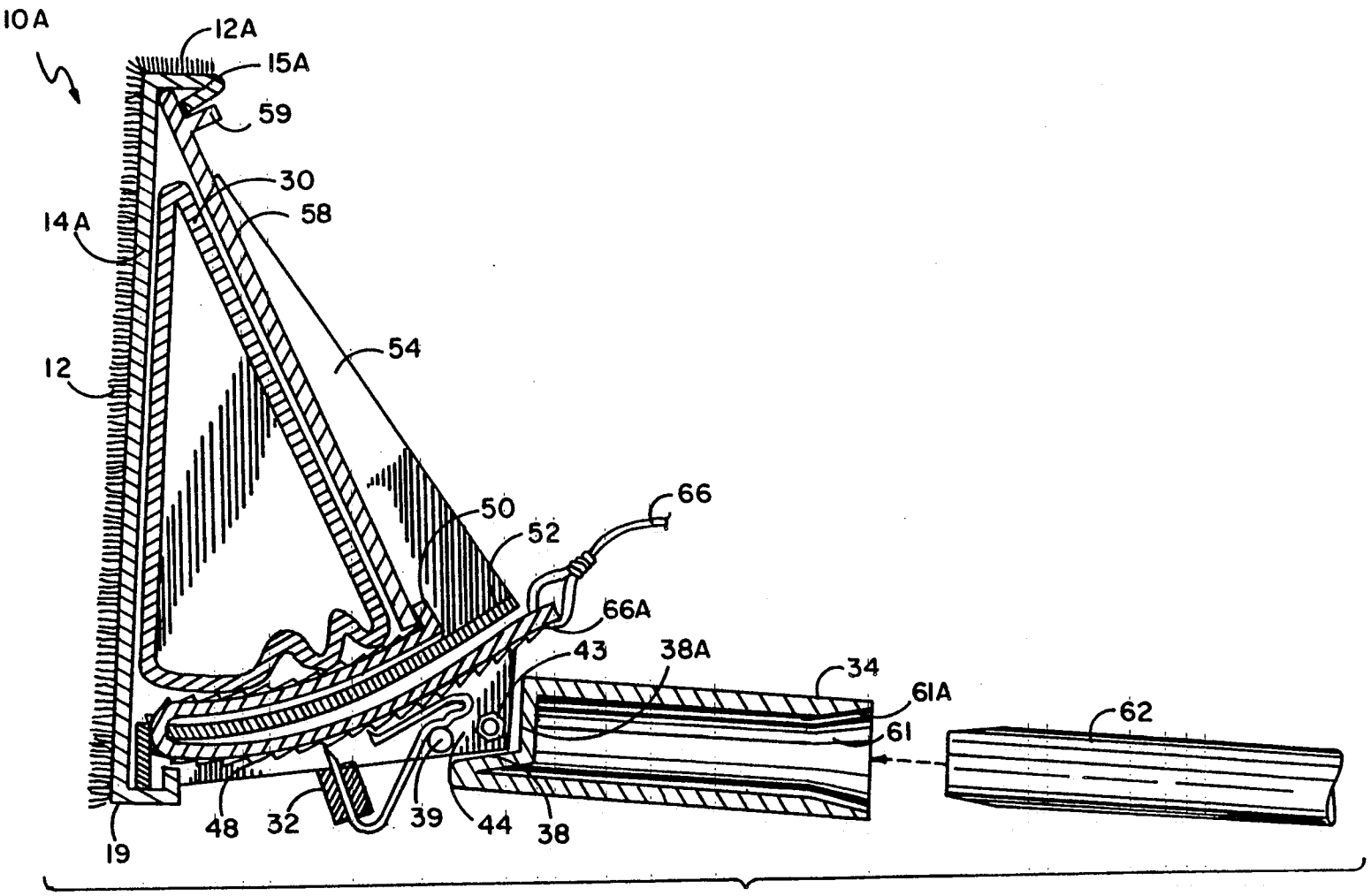
FIG. 4 is an elevational cross-sectional view of a similar view as illustrated in FIG. 3 but with the pressure plate maneuvered inward by action of the ratchet mechanism and with the paint bag shown partially empty.

As mentioned in the prior art statement, there is no fixed integral face plate in the housing of this invention. A separate metal face plate 14 is provided on which paint pad 12 is adhered. Front face 14 has extensions 15 end 19, respectively, at its top and bottom. Top extension 15 extends rearward and then curves downward and bends around sharply back toward the face plate, forming inwardly extending portion 29. In some embodiments paint pad 12 can extend on top of extension 15 to form paint pad **12*a* as seen in FIG. 4 to paint an adjoining edge to the surface paint pad 12 is painting such as the butt heel of shingles. As seen in FIG. 2, there are two notches 21 and 25 formed in the inwardly extending portion 29 of top extension 15. The area between these notches forms a hinge receipt attachment area. At the bottom of face plate 14, bottom extension 19 extends inward and then upwards slightly and has notch 23 defined in a central portion of the upwardly extending portion. There are also three or more openings provided in metal face plate 14 which conform to openings that are formed in the paint pad. Each of these openings in face plate 14 has placed around and adhered to it an annular, self-adhesive disk 18 having self-adhesive material on both sides thereof. These disks are open in the center so that the paint can pass therethrough when the bag is adhered to the inwardly facing adhesive on each disk. Face plate 14, being separate from the housing, bows out at its center when pressure is applied thereto, which bowing is desirable for the smooth application of paint. To attach face plate 14 to housing 13, one slips bottom extension 19 of face plate 14 around bottom lip 20*b*. At that pointface plate 14 is moved rearward toward the top of the housing, and the inwardly extending portion 29 of top extension 15 slides over the tops of first and second side members 24 and 54 until notches 21 and 25 align respectively with catch members 22 and 56. As top extension 15 slides over side members 24 and 54, they will compress the inwardly extending portion 29 of top extension 15. When notches 21 and 25 align respectively with first and second catch members 22 and 56, the compression is released because nothing contacts the inwardly extending portion 29 of top extension 15 and the inwardly extending portion 29 of top extension 15 snaps downward catching the inside of notches 21 and 25 securely on catch members 22 and 56, respectively. The two ends 17 and 27 of the inwardly extending portion 29 of extension 15 press against and catch on the rear of side lips 20 and 20*a*, respectively, preventing movement of face plate 14 away from housing 13. In this way face plate 14 is quickly and simply attached. To remove face plate 14, one reverses the steps by compressing the inwardly extending portion 29 to release it from first and second catch members 22 and 56 and moves face plate 14 forward and downward to release bottom extension 19 from bottom lip 20*b* of housing 13. pressure plate 58 is a generally rectangular planar member having a front, a rear, a top 58*a* and bottom 58*b*. On pressure plate 58 is rear rib member 59 extending horizontally from side to side just below top 58*a* of the pressure plate. The width of pressure plate 58 fits within first and second side members 24 and 54, and its height is no longer than the distance from the innermost portion 29*a* of the inwardly extending portion 29 of top extension 15 to the outer edge 52*a* of housing bottom 52. Top 58*a* of pressure plate 58 is hingeably positioned by pushing it under the innermost portion 29*a* of inwardly extending portion 29 of lip 15 when face plate 14 is installed on housing 13. Top 58*a* of pressure plate 58 can contact the inside top of face plate 14 or be held slightly below it. Rear rib member 59 helps to hold pressure plate 58 in place as inwardly extending portion 29 of extension 15 pushes against it as well as acting as a bag closure in an embodiment to be described below. Thus pressure plate 58 can be swung back and forth with its top 58*a* caught under the innermost portion 29*a* of inwardly extending portion 29 of extension 15, with the entire length between notches 21 and 25 acting as retention means and creating a hinge action with pressure plate 58 which can be swung in an arc between first and second side members 24 and 54 and above bottom 52 of housing 13. To remove the pressure plate, one pulls it rearward until bottom 58*b* is beyond outer edge 52*a* of bottom 52 and then pulls it downward, thereby pulling the pressure plate's top 58*a* away from face plate 14 and its inwardly extending portion 29 of top extension 15**.

Paint-containing bag 30 is triangular in shape and is the subject of a co-pending patent application of the Applicant. To position bag 30 properly within the housing, the bag is urged against the adhesive surfaces of annular disks 18, and then the bag is punctured by pushing a sharp object through the holes in paint pad 12. One must then maneuver the then hinged pressure plate 58 against the bag to force the paint through apertures 16 in adhesive annular disks 18 and through face plate 14 out onto paint pad 12 for application of the paint.

Figure 7:
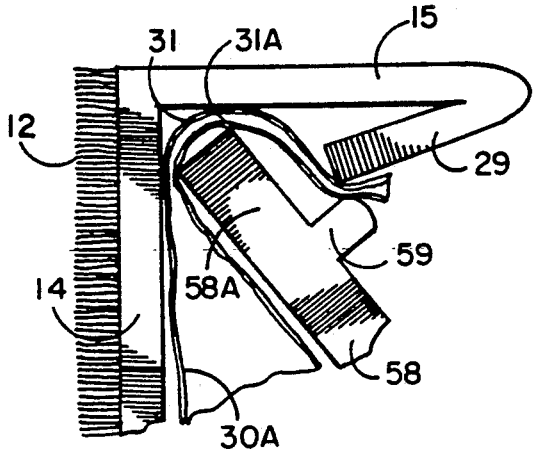
FIG. 7 is a partial cross-sectional view of an alternate embodiment of the device of this invention showing a refillable paint bag, the top of which is sealed by the pressure plate positioned against the top extension of the removable face plate.

FIG. 7 illustrates a cross-sectional cutaway view of the top of pressure plate 58, face plate 14 and top extension 15 of face plate 14. Also illustrated in this view is the top of an alternative refillable paint bag 30*a* which has its top side open with the front and rear sides of the bag designated 31 and 31*a*, respectively. This open top allows bag 30*a* to be refilled by the user when desired. The top of bag 30*a* extends upwards with the front and rear sides 31 and 31*a* of the open top exending against the rear of face plate 14 and the bottom of top extension 15 and are compressed thereagainst by the top 58*a* of pressure plate 58. Further compression and sealing of the bags front and rear sides 31 and 31*a* is accomplished when sides 31 and 31*a* pass against the inwardly extending portion 29 of top extension 15 where the sides 31 and 31*a* are compressed by contact with rib member 59 which exends horizontally across the top rear of pressure plate 58. As can be seen in FIG. 7, the compression of rib member 59 against the inwardly extending portion 29 of extension 15 further seals the ends of sides 31 and 31*a* of bag 30*a* so as to prevent any escape of paint therethrough. Top 58*a* of pressure plate 58 further helps to seal the two open sides 31 and 31*a* of bag 30*a* by compressing them against face plate 14 and top extension 15. This combination of places of compression of sides 31 and 31*a* of bag 30*a* helps to seal the bag as pressure plate 58 is forced against the bag as pressure plate 58 is being hingeably inserted in the housing.

Figure 3:
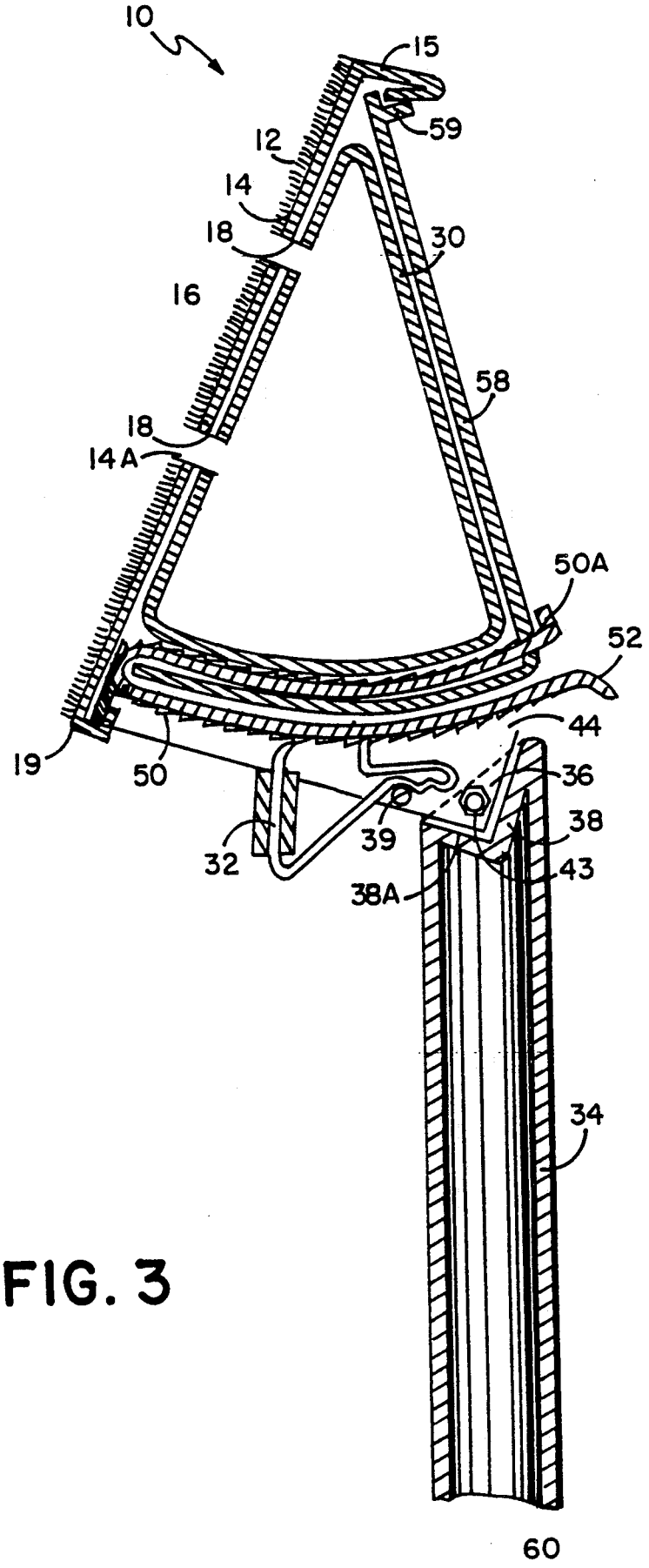
FIG. 3 is an elevational cross-sectional view of my invention through a center line showing the paint bag full.
Figure 8:
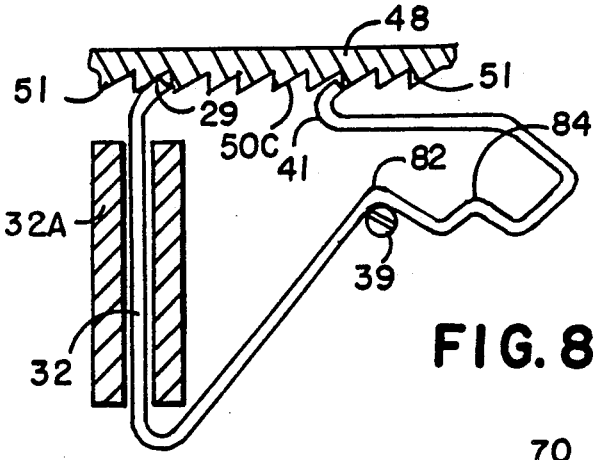
FIG. 8 is an elevational sectional view of the trigger ratchet.

A simplified ratchet system is utilized in my new invention which, as mentioned above, is a significant advancement in the art in function, economy and operation. The system utilizes cable 50 having recessed serrated teeth 50*c* on one side and an enlarged end forming a catch member 50*a*. Cable 50 can be made of well-known cable tie material. Cable 50 passes along the central portion of the upper surface of the housing bottom 52 which housing bottom includes notch 50*b* at its mid-front through which cable tie 50 passes. Further, a notch 23 in bottom extension 19 of face plate 14 allows passage of cable 50 to extend therethrough to around and under housing bottom 52. Catch member 50*a* at the end of cable 50 is engaged into notch 60 formed at the midbottom of pressure plate 58 when pressure plate 58 is positioned in its hinged mode within housing 13. Serrations 50*c* are aimed upward within the paint bag containing area of the housing and do not catch on the paint bag positioned therein because such serrations are recessed within the cable. When the cable is pulled downward through notch 50*b*, it pulls catch member 50*a* forward towards face plate 14 which action squeezes the paint bag and forces the paint through apertures 16 onto paint pad 12 for application. On the bottom of housing bottom 52 is a pair of spaced-apart planar handle attachment members 44 and 44*a* having two apertures formed in each across from one another. Handle attachment members 44 and 44*a* can be formed as an integral part of the bottom of housing bottom 52 and form between them slot 44*b*. The bottoms and ends of handle attachment members 44 and 44*a* are formed at a right angle and are adapted to receive a handle at various angular positions as will be described further below. Trigger ratchet 32, as seen in FIGS. 3 and 4 and in an enlarged separate view in FIG. 8, is adapted to engage with serrated teeth 50*c* of cable 50 as cable 50 passes thereabove along the bottom surface of housing bottom 52, such serrated teeth 50*c* then pointing downward. Trigger ratchet 32 can be formed of a narrow strip of bent spring metal having a straight finger-engaging portion 32*a* surrounded by an encircling piece of rubber tubing to cushion the user's finger when in use. When one pulls trigger ratchet 32, front tab 33 which extends upwards and slightly rearwards from finger-engaging portion 32*a* catches into one of the serrations 50*c* on cable 50 and when front tab 33 is pulled by depressing trigger ratchet 32, cable 50 is pulled rearward which action pulls cable 50 through notch 50*b* and also then pulls pressure plate 58 forward. Trigger ratchet 32 includes first bend 82 and second bend 84 which form two arched recesses and which then loop back in a reverse curve and extends upwards to form rear tab 41. When the finger-engaging portion 32*a* is pulled rearward by the user's finger thereby pulling cable 50, cable 50 moves to the rear within slot 44*b*, and rear tab 41 catches on a serrated tooth 50*c* and holds cable 50 maintaining the position of cable 50 while the finger-engaging portion, when released by the finger, springs back to its original position to again engage with another serration. The process continues until cable 50 has been pulled through slot 44*b* by the trigger ratchet completely closing pressure plate 58 and forcing the paint within the paint bag thereout. Pin 39 extends between the first pair of apertures 47 formed within the handle attachment members 44 and 44*a* extending from one to the other around which pin in normal operation first bend 82 of trigger ratchet 32 extends and which retains trigger ratchet 32 in place with its front and rear tabs 33 and 41 engaged into serrations 50*c* of cable 50. To release the engagement of tabs 33 and 41 with cable 50, one can pull trigger ratchet 32 forward so that first bend 82 disengages from pin 39 and second bend 84 then engages over pin 39. This action allows trigger ratchet 32 to pivot downward, pulling tabs 33 and 41 from cable 50. This movement disengages trigger ratchet 32 from cable 50 which can then be pulled freely by catch member 50*a* rearward which rearward movement moves pressure plate 58 backwards allowing it to be opened for reloading with a new, full paint bag when the paint bag contained within the housing is empty Once a new paint bag is reloaded within the housing, the trigger ratchet mechanism can be pushed inwards so that first bend 82 is again engaged over pin 39 and tab members 33 and 41 are again engaged into serrations 50*c* in cable 50. Again, as mentioned above, by recessing the serrations within cable 50 which cables are well-known in the art of cable ties, there is a smooth outer face on the upper surface of the cable within the housing which smooth surface contacts the paint bag, eliminating any danger of tearing or puncturing the bag. After trigger ratchet 32 is disengaged from cable 50, catch member 50*a* can be grasped, allowing easy pulling back of pressure plate 58.

In one embodiment of the device of this invention the end of cable 50 can extend beyond the bottom surface of housing bottom 52 as seen in FIG. 4 and can have formed at the protruding end thereof an aperture 66*a* which can receive a string member 66. In cases where additional force may be needed to close pressure plate 58 against the paint bag, one can grasp string member 66, pull on the cable end which action will force the further compression of the bag as seen in FIG. 4 where bag 30 is partially compressed by movement of pressure plate 58. Applicant feels that the trigger ratchet and pulling cable combination of this invention can be used in other applications for an inexpensive and simple means of creating incremental movement when needed.

As mentioned above, parallel handle attachment members 44 and 44*a*, having slot 44*b* formed therebetween, have a second pair of apertures 40 formed across from one another which form part of slot 44*b*. Handle 34, as seen in FIG. 1, has a narrow web 36, as will be described further below, which is adapted to fit within slot 44*b*. Handle attachment members 44 and 44*a* at the rear of the housing are formed at an angle with slot 44*b*. The angled outer edges of handle attachment members 44 and 44*a* are utilized to help position the handle when attached thereto. In some embodiments the housing and handle attachment members can be molded in one piece out of plastic. Handle 34 is a rigid hollow shaft having at its top a protruding web 36 with angled receiving surfaces 38 and 38*a* on each side of web 36 which abut the outer edges of handle attachment members 44 and 44*a* when web 36 is placed within slot 44*b*. Aperture 43 is provided in web 36 which, when the web is placed within slot 44*b*, aligns with the pair of apertures 40 in handle attachment members 44 and 44*a*, allowing bolt 46 to be passed therethrough with a nut being placed on the other end of bolt 46 which, when tightened, securely attaches handle 34 to the handle attachment members. The handle, though, can be attached to the casing at two different angles by reversing the orientation of the handle. The handle is removably attached by removing the nut and bolt and can be positioned at different angular orientations to the casing for painting surfaces at different angles. As seen in FIG. 3, surfaces 38 and 38*a* are positioned with surface 38 at the end of handle attachment members 44 and 44*a*, and surface 38*a* at the bottom of handle attachment members 44 and 44*a*, which positionings position the handle at approximately 15 degrees to the housing which handle position is useful for painting vertical walls. If the handle is detached from the handle attachment members 44 and 44*a* and rotated so that the orientation of surfaces 38 and 38*a* is reversed, as seen in FIG. 4, with surface 38 along the bottom of the handle attachment members and surface 38*a* along the end of the handle attachment members, then the handle is positioned at approximately 75 degrees to the housing which positioning is useful for painting ceilings. Alternate handles can have surfaces 38 and 38*a* cut at different angles to one another so that the handle can be reversibly positioned at the option of the user for various purposes such as having the handle positioned at 30 degrees to the housing for painting walls or if the handle is reversed at 60 degrees to the housing for painting floors. An opening 61 is provided at the other end of handle 34 which may have an inward taper 61*a* for receiving an extension pole 62, as seen in FIG. 4, for allowing the handle to be lengthened to reach difficult locations or high ceiling surfaces. The end of handle extension pole 62 can also be tapered to fit easily within the tapered end 61*a* of handle 34 so that they can be tightly engaged and held securely to one another by friction fit but are disengageable.

Figure 5:
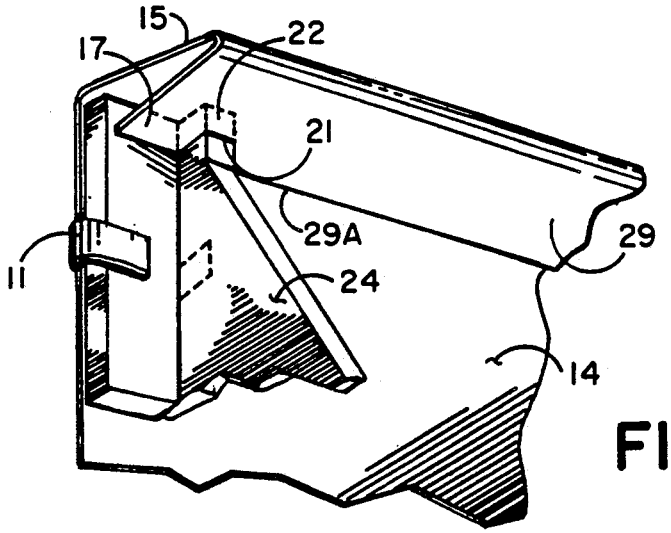
FIG. 5 is a partially cutaway perspective view of the housing illustrating how the removable metal face plate supporting the paint pad is attached to the housing.

In FIGS. 1 and 5 there is seen a removable U-shaped edge guide 11 which slides onto one side lip, or if two edge guides are used, both side lips 20 or 20*a*. Edge guide 11 can be made of molded nylon to create a slippery protrusion at the side of the paint applicator of this invention. Edge guide 11 serves to separate the side of the paint applicator from an abutting surface such as a perpendicular wall or molding adjacent to the surface being painted. Edge guide 11 functions by placing the face plate of the device a sufficient distance away from the adjacent surface so that the paint pad does not touch the adjacent surface but the fibers of the paint pad are long enough to apply paint to just cover the space between the paint pad and the abutting surface but such fibers of the pad do not extend long enough to apply paint to the abutting surface. Edge guide 11 has a portion which extends over the front of the side lip and extends between the side lip and face plate 14. Since face plate 14, as explained above, bows outward during use, edge guide 11 does not affect the application of paint. Edge guide 11 can extend around the side lip from the rear of the lip to the front of the lip and then have an inwardly extending tab to catch on the inside of first side member 24 and can be moved up or down on the side lip as desired.

Figure 6:
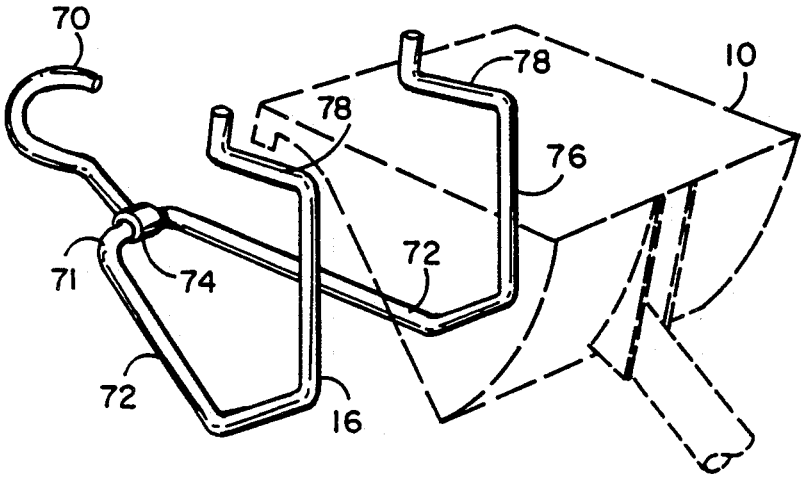
FIG. 6 is a perspective view showing a stand and hanger with the device of this invention denoted by dotted lines.

In FIG. 6 a combination stand and hanger 71 is shown resting on a horizontal surface with device 10 of this invention shown in dotted lines resting on it with the paint-applying surface facing upwards which position prevents paint from dripping out of the openings in the paint pad. The combination stand and hanger can be formed of wire bent into a rigid U-shape having hook 70 at the apex of the "U" and two legs 72 extending from the apex to rest on the horizontal surface when used as a stand while the end resting bars 78 with turned-up retainer ends serve as the resting place for the paint applicator device. Two arched cradle segments 76 extend between straight legs 72 and resting bars 78 and serve to elevate the device of this invention so that the handle can hang down to a horizontal surface. In this way the device of this invention can be placed at rest without any paint spilling therefrom.

Figure 9:
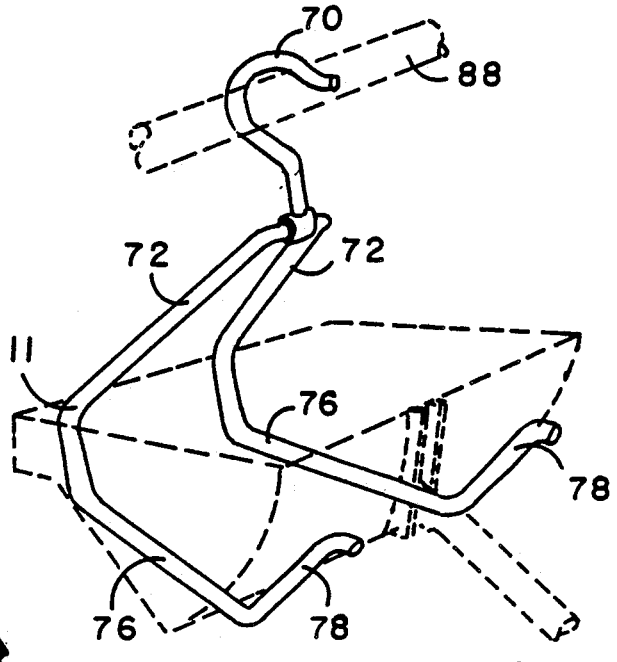
FIG. 9 is a perspective view showing the stand of FIG. 6 used as a hanger with the device of this invention denoted by dotted lines.

In FIG. 9 the combination stand is shown with hook portion 70 used to hang on rung 88 of the ladder which is shown in dashed lines with the device 10 of this invention resting in the arched cradle segments 76 with the paint pad facing upward.

Figure 10:
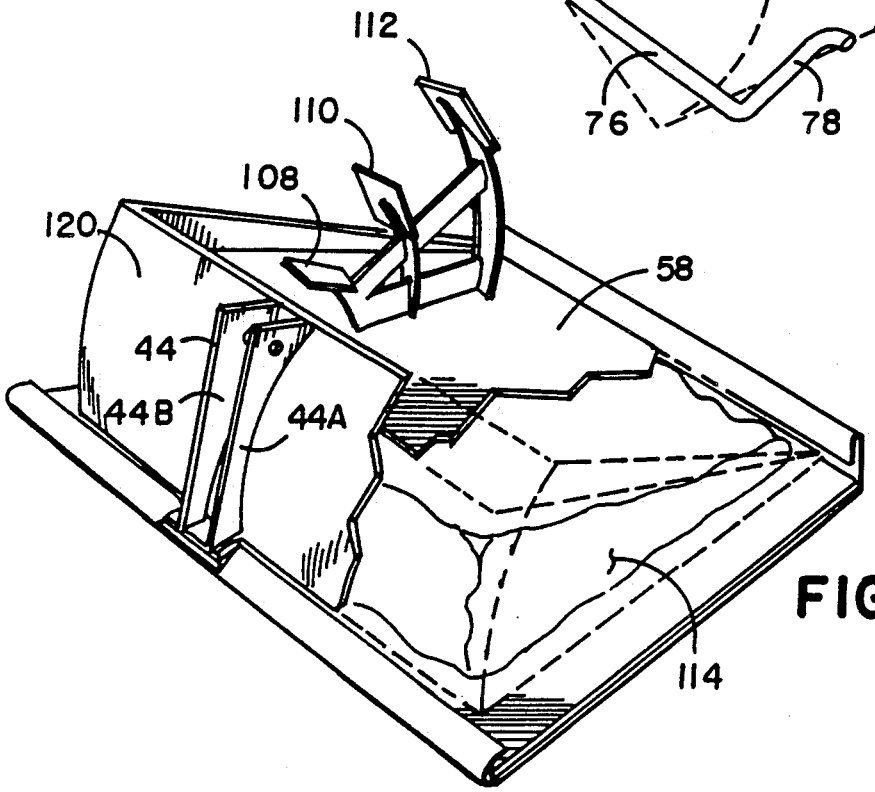
FIG. 10 is a perspective view of the embodiment of the device of this invention utilizing thumb-operated pressure to the pressure plate.

Other embodiments of this device having different means to close pressure plate 58 have also been developed. FIG. 10 illustrates one such alternate embodiment where no trigger mechanism or cable apparatus is used to close pressure plate 58. Instead pressure is applied to the pressure plate by a series of thumb pusher members 108, 110 and 112. One can hold the device with a very short handle attached to handle attachment members 44 and 44*a* and position the hand with the fingers around the handle with the user's thumb resting on one of the thumb pusher members. When pressure plate 58 is at its outermost position when the bag 114, as seen in FIG. 10, is full of paint, one can easily rest one's thumb on pusher member 108 and push inward, forcing paint out of bag 114 through the apertures onto the pad until thumb member 108 is depressed inward a distance where it is no longer easy to reach at which point thumb pusher member 110 will have come into reach as pressure plate 58 swings downward, and one can then push on thumb pusher member 110, forcing the pressure plate in further until a point when thumb pressure member 110 is no longer easy to reach and one can then push upon thumb pressure member 112 until pressure plate 58 is pushed all the way forward, completely emptying paint bag 114. The thumb pusher members consist of curved arms which extend out of the rear of pressure plate 58 with thumb pusher member 108 being disposed toward the bottom of pressure plate 58 and shorter than thumb pusher member 110 and which is disposed midway up pressure plate 58. Thumb pusher member 112 is disposed further to the top of pressure plate 58 and is the longest of the thumb pusher members so it extends outward further when the pressure plate is nearly in a closed position.

Figure 11:
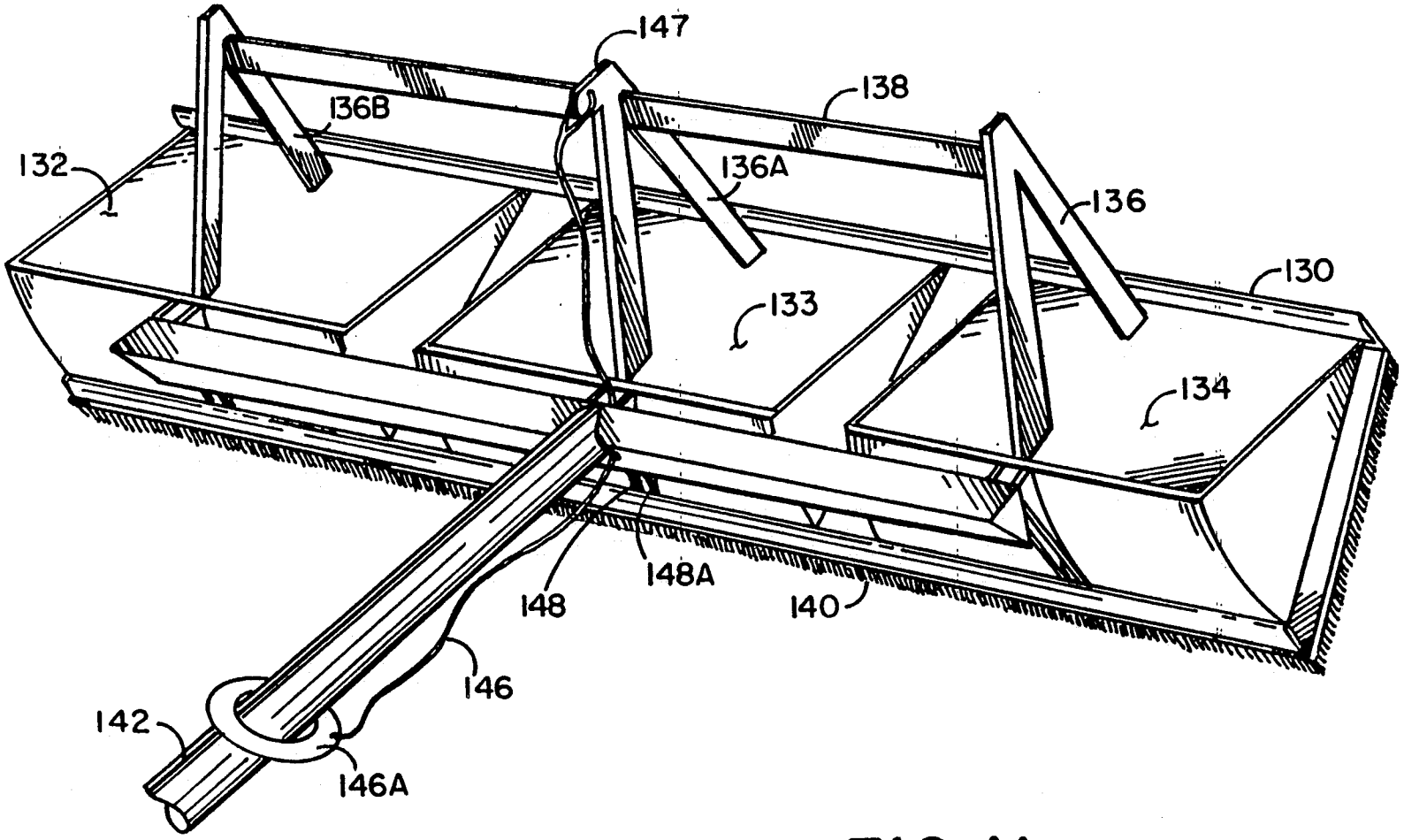
FIG. 11 illustrates an alternate embodiment of the device of this invention showing three housings held in tandem with a leverage arm to apply pressure to the pressure plates activated by pulling on a cable.

FIG. 11 illustrates a view of the embodiment of this invention having three housings held in tandem, having an elongated paint pad and face plate 130 of similar construction to the construction of the face plate as previously described but extending across the front of three housing units 132, 133 and 134 which are held on support member 140. Extending from the rear of each of the pressure plates of these housings is an arm member which is attached to an interconnecting crossbar 138 which interconnects all arm members 136, **136*a* and 136*b* together so that pressure on crossbar 138 downward will cause the pressure plates to hinge forward as described above to force the contents of the paint bags held within each housing through the apertures onto the paid pad. Handle pole 142 can be affixed to support member 140. Stretchable cable member 146 can be attached to attachment point 147 at a central position on crossbar 138 and the cable can pass through slot 148*a* and if pulled by hand or by other pulling mechanisms, will cause arms 136, 136*a*, and 136*b* to be pulled downward thereby closing the pressure plates uniformly as cable 146 is pulled downward. A locking ring ratchet can be used around handle 142 which is attached to stretchable cable 146. As cable 146 is pulled, it stretches the cable and forces the arms to push the pressure plates to squeeze paint out of the bags onto the paint pad. As the cable is pulled, the attached locking ring ratchet 146*a* is moved down pole 142 and locks in place because of its angular disposition around pole 142 and the locking ring ratchet will not move upwards on pole 142 unless it is maneuvered substantially perpendicular to pole 142. In this way one can pull cable 146 and lock locking ring ratchet 146*a* at a position on pole 142 where there is tension stretching cable 146 which tension continues to apply force to the arms until the tension is relaxed in the stretchable cable from the arm movement closing the pressure plates on the paint bags reducing the distance between the arm and locking ring ratchet 146*a*. From the tension from the stretched cable 146, pressure is maintained on the arms until the stretched cable has relaxed its tension. One can then re-tension the stretched cable by maneuvering locking ring ratchet 146*a* to a position perpendicular to pole 142 and pulling downward on locking ring ratchet 146*a* and cable 146 thereby restretching cable 146** to again apply pressure to the arms until the cable's stretched condition again relaxes when the cable has pulled the arms further to close the pressure plate and force more paint out of the paint bag. By using a device having this type of configuration, wide areas can be painted at one time.

Although the present invention has been described with reference to particular embodiments, it will be apparent to those skilled in the art that variations and modifications can be substituted therefor without departing from the principles and spirit of the invention.

I claim:

1. A paint applicator for applying paint contained within a paintholding bag, comprising:

a housing for receipt of said paint bag, said housing including:

a bottom having a pair of opposing side edges, a front, a rear and an upper and lower surface;

a generally triangular-shaped first side positioned on one side edge of said bottom extending upwards from said bottom's upper surface;

a generally triangular-shaped second side positioned on the opposite side edge of said bottom from said first side, said second side extending upwards from said bottom's upper surface;

a first lip positioned along an edge of said first side nearest the front of said bottom, said lip extending from said side outward away from said bottom;

a second lip positioned on the opposite edge of said bottom from said first side nearest the front of said bottom, said lip extending from said side outward away from said bottom;

a bottom lip extending downward from the front of said bottom;

a substantially rectangular face plate having a flexible planar body having a top and bottom and front and rear surfaces, said face plate having a plurality of apertures defined therein, said face plate further including:

an upper extension formed as a part of said face plate extending rearwards from the top of said face plate first perpendicularly and then bending in a reverse curve to form an inwardly extending portion of said upper extension, said inwardly extending portion having a pair of spaced apart notches defined therein;

a lower extension formed as a part of said face plate extending from the rear of the bottom of said face plate first perpendicularly to said body in the same direction as, and parallel to, said upper extension and then extending upwards toward said upper extension substantially parallel to said face plate;

said face plate removably engageable to said housing by engaging said housing's bottom lip within said lower extension and by engaging the tops of said first and second sides with said notches in said inwardly extending portion of said upper extension;

a paint pad adhered to the front surface of said face plate, said paint pad having a plurality of apertures defined therein, said apertures aligning with said apertures in said face plate;

means for attaching said paint bag positioned within said housing in a fluid-tight relation to said rear surface of said face plate;

a substantially rectangular pressure plate having a top and a bottom and opposing sides, said pressure plate positioned in said housing with its top removably and hingeably positioned between said face plate and the inwardly extending portion of said upper extension of said face plate, the sides of said pressure plate adapted to fit within said housing between said sides and above said bottom; and means to urge said pressure plate against said paint-containing bag to force said paint out of said paint bag through the apertures in said face plate and paint pad onto said paint pad for application of said paint.

2. The applicator of claim 1 further including: handle means positioned on the lower surface of the bottom of said housing.

3. The applicator of claim 1 wherein said means to urge said pressure plate against said paint bag comprises:

a serrated cable, having first and second ends, positioned serration-side up within said housing under said paint bag, said cable's first end engaged with the bottom of said pressure plate, said cable extending under said housing bottom and pulled by a finger-operated trigger ratchet having a first tab engaging one of said serrations at a time and pulling said cable rearwards under said housing bottom to pull said cable on top of said housing bottom forward.

4. The applicator of claim 3 further including:

a notch defined in the front of said housing bottom, allowing passage of said cable therethrough;

a spaced-apart pair of handle attachment members positioned on the bottom of said housing forming a slot therebetween containing said cable and said trigger ratchet;

a pin member extending from one of said handle attachment members to the other; and said trigger ratchet being of spring-like material having a first and second end and having a finger-contacting portion extending up to said first tab, said trigger ratchet bending at an acute angle to a first bend and then to a second bend whereupon it extends in a reverse curve and then upwards to form a second tab, said trigger ratchet in a first position with said first bend engaged around said pin member adapted to be pulled rearward by finger action and to pull said cable by its engagement with said first tab and upon release of said finger's pressure, said trigger ratchet finger-contacting portion and first tab to move forward to engage another serration while said second tab retains said cable in its then advanced position.

5. The applicator of claim 4 having said trigger ratchet pulled forward disengaging said first bend from said pin member and engaging said second bend on said pin member, said trigger ratchet extending downward to disengage said first and second tabs from the serrations in said cable to allow said cable to be moved freely for installing a paint bag in the housing of said applicator.

6. The applicator of claim 1 wherein said means for attaching said paint bag to said face plate comprises:

at least one substantially annular disk having self-adhesive material on both sides thereof with one side adhered to said face plate around at least one of said face plate apertures and the other side removably adhered to a surface of said paint bag by said self-adhesive material.

7. The applicator of claim 1 further including:

at least one handle attachment member disposed on the lower surface of the bottom of said housing; and a handle member having one end disposed at an angle for mounting alternately in two angular orientations to said handle attachment member.

8. The applicator of claim 1 wherein said means to apply pressure to said pressure plate comprises a plurality of thumb pusher members to be pushed in turn by the user's thumb, forcing said pressure plate forward.

9. The applicator of claim 1 further including a rib on the upper rear of said face plate to aid in sealing a refillable paint bag having open ends when said open ends are extended between the inside top of said face plate and the upper extension by said rib contacting said rearwardly extending portion of said upper extension and compressing the open ends of said refillable paint bag.

10. The applicator of claim 1 further including an edge guide attached to at least one of said lips of said housing, said edge guide disposed between said face plate and said lip, said edge guide protruding beyond the edge of said face plate and paint pad.

* * * * *